US005803345A

United States Patent [19]

Jones et al.

[11] Patent Number: 5,803,345

[45] Date of Patent: Sep. 8, 1998

[54] SELF-LOCKING BOX WITH OPENING DEVICE

[75] Inventors: M. Lee Jones; H. English Robinson, Jr., both of Atlanta, Ga.

[73] Assignee: Why Wrap? Incorporated, Atlanta, Ga.

[21] Appl. No.: 794,227

[22] Filed: Jan. 30, 1997

Related U.S. Application Data

[60] Provisional application No. 60/011,028 Feb. 2, 1996.

[51] Int. Cl.[6] ..... B65D 5/43

[52] U.S. Cl. ..... 229/102; 206/807; 229/148; 229/244

[58] Field of Search ..... 229/102, 148, 229/198.2, 243, 244; 206/807

[56] References Cited

U.S. PATENT DOCUMENTS

| | | | |
|---|---|---|---|
| 636,806 | 11/1899 | Johnstone | 229/148 |
| 1,108,464 | 8/1914 | Morey | 229/102 |
| 4,917,288 | 4/1990 | Heitele et al. | 229/148 |
| 5,350,108 | 9/1994 | Friar et al. | 229/148 |
| 5,507,428 | 4/1996 | Robinson, Jr. et al. | 229/148 |

FOREIGN PATENT DOCUMENTS

| | | | |
|---|---|---|---|
| 2504892 | 11/1982 | France | 229/148 |
| 2846467 | 5/1980 | Germany | 229/148 |
| 3340798 | 3/1984 | Germany | 229/148 |
| 3840879 | 7/1990 | Germany | 229/148 |
| 2251600 | 7/1992 | United Kingdom | 229/148 |

*Primary Examiner*—Gary E. Elkins
*Attorney, Agent, or Firm*—Jones & Askew, LLP

[57] ABSTRACT

A box for containing goods during storing, delivering, mailing, or shipping. The box has at least one closure panel secured to a body panel to selectively close an opening in the box. A locking tab on the box selectively engages a panel of the closed box, so that the box cannot be opened without separating the locking tab and thereby providing visible evidence of the opening. The locking tab includes an opening tab to separate at least part of the locking tab in a predetermined manner, by pulling the opening tab.

9 Claims, 2 Drawing Sheets

SELF-LOCKING BOX WITH OPENING DEVICE

CROSS-REFERENCE TO RELATED APPLICATION

This application claims the benefit of U.S. Provisional Application Ser. No. 60/011,028 filed Feb. 2, 1996.

BACKGROUND OF THE INVENTION

The present invention relates generally to boxes, and more specifically to boxes for storing, mailing, or shipping various articles.

Boxes for storing, mailing, or shipping goods have been known in the prior art. In their simplest embodiment, those boxes comprise several body panels forming the sides of the box, and a pair of end panels connected to one or more of the side panels to close the ends of the box. The end panels usually are secured to the side panels by adhesive tape or the like, to close the box. The end panels may terminate with folded flap portions which are inserted beneath one of the body panels to provide a self-securing closure, but such conventional closures usually are less secure than taping shut the box panels. The conventional box may also feature a plurality of overlapping panels which are secured to each other by means of adhesive to form integral end panels. U.S. Pat. No. 3,512,823 is an example of such a box structure.

U.S. Pat. No. 5,350,108, assigned to the owner of the present application, discloses an improved self-locking box.

That patent describes a box having at least one panel secured to another panel by a locking tab and slot assembly, so that the secured panel cannot be opened without leaving visible evidence of tampering. To accomplish that locking, the box of the '108 patent includes an end panel having a flap extending into the box.

The slot is located in the flap. The locking tab is foldable to fit through the slot, and a terminal portion of the locking tab engages a surface on the interior of the box so as to prevent withdrawing the locking tab. However, there remains at least some possibility that a box with the self-locking structure shown in the '108 patent might be nondestructively opened by a determined person who knew the internal construction of the box and had the time and the tools to defeat the lock structure.

U.S. Pat. No. 5,507,428, also assigned to the owner of the present application and incorporated herein by reference, discloses another self-locking box that makes difficult or impossible any nondestructive opening of a box equipped with a locking tab as disclosed therein. The box of the '428 patent preferably includes a secondary end panel extending outwardly from the body panel and foldable to close over an end of the box.

The secondary end panel thus lies in substantially parallel relation to the end panel when the box is closed, and prevents anyone from seeing the contents of the box by bending the end panel back from the end of the closed box.

Authorized opening of the boxes disclosed in the '108 and '428 patents takes place by cutting, tearing or otherwise separating the locking tab from the box panel forming that tab. There may be difficulty in manually tearing the locking tab, particularly in boxes fabricated of material having sufficient strength to withstand shipping by parcel delivery services or other commercial services. Although the locking tabs of those boxes are defined by perforated or scored regions to facilitate folding the locking tabs as disclosed therein, the manual force required to break apart or otherwise separate such locking tabs, without using scissors or some other implement as a makeshift tool, may impede the authorized opening of a box so equipped.

SUMMARY OF THE INVENTION

Accordingly, it is an object of the present invention to provide an improved self-locking box.

It is another object of this invention to provide a self-locking box structure that is relatively easy to open in a predetermined manner.

Yet another object of the present invention is to provide a self-locking box that cannot be opened without separating the locking tab from part of the box, thereby providing visible evidence of tampering, and that is openable by separating the locking tab from another part of the box in a predetermined manner.

Other objects of the invention, in addition to those set forth above, will become apparent to those skilled in the art from the following disclosure.

Stated in broad terms, a box according to the present invention has a locking tab formed in a part of the box, and a flap associated with an adjacent selectively-operable part of the box. The flap includes a slit, and the locking tab is selectively inserted through the slit when the box is closed. A surface of the inserted locking tab abuts the interior of the box, preventing withdrawal of the locking tab from the slit. The box is intentionally openable by structure on the locking tab defining an opening tab that separates the locking tab from the adjacent part of the box when the opening tab is pulled in a predetermined manner. When the locking tab is thus separated, the adjacent part may be opened for gaining access into the box. However, the separation of the locking tab gives visible proof that the once-locked box has been opened.

Stated in somewhat more detail, boxes according to the present invention have an end panel foldable to close an end of the box. The end panel has a flap extending to overlap an end of a body panel adjacent to the open end of the box, when the end panel closes that open end. A slit is formed in the flap of the end panel and overlays an opening in the body panel of the box when the end panel is folded to close the box. The locking tab is connected to the body panel adjacent to the overlapping location of the end flap. A first portion of the locking tab is foldable to lie alongside a second portion thereof, with the fold line forming a leading edge of the folded locking tab. The locking tab partially unfolds within the box, abutting the flap within the closed box and thereby locking the end panel in closed relation with the box. One or a plurality of diagonal lines or other regions of predetermined weakness are associated with the locking tab and define, at least in part, the opening tab.

The regions of predetermined weakness defining the opening tabs preferably are perforated lines formed in the locking tab. For example, two lines of perforations may extend from a common point midway across the locking tab, on diagonal paths toward opposite sides of the locking tab, intersecting other cut lines extending inwardly from those sides and at least in part defining a pair of opening tabs. Pulling each opening tab away from the locking tab separates the regions of predetermined weakness, thereby separating the locking tab without requiring a cutting tool.

BRIEF DESCRIPTION OF THE DRAWINGS

FIG. 4 shows the box partially broken away for illustrative purposes.

DETAILED DESCRIPTION OF PREFERRED EMBODIMENT

Figure 1:
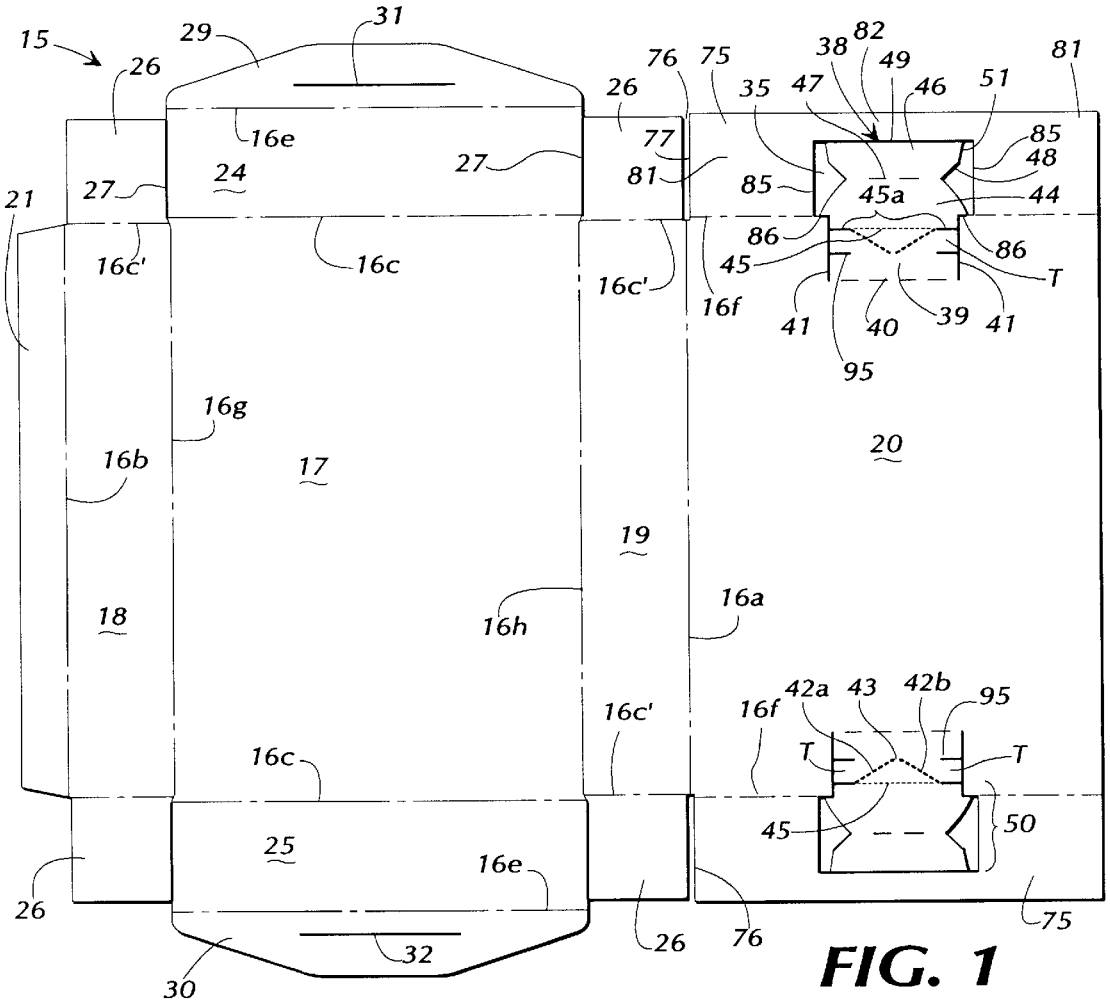
FIG. 1 is a plan view showing a box blank for producing a box according to a preferred embodiment of the present invention.

Turning first to FIG. 1, there is shown generally at 15 a box blank die-cut or otherwise formed from a suitable material such as corrugated board or the like. The box blank 15 includes a number of distinct panels defined by the several score lines 16*a* . . . 16*h* formed in the board while forming the blank, in a manner known to those skilled in the art. The distinct panels include the bottom panel 17 flanked by a pair of side panels 18 and 19 across the respective lengthwise score lines 16*g* and 16*h*, and a top panel 20 contiguous to the side panel 19 across the score line 16*a*. A glue flap 21 adjoins the opposite side of the side panel 18, across the score line 16*b* at one edge of that side panel. The box blank 15 may be fabricated from any corrugated or noncorrugated paperboard, or from nonpaper material suitable for box production.

Adjoining the ends of the bottom panel 17 and separated therefrom by the two score lines 16*c*, are the two end panels 24 and 25. A pair of corner flaps 26 flank the end panel 24, separated therefrom by the cut lines 27 perpendicular to the score line 16*c* and defining the sides of that end panel. Each corner flap 26 further is defined by the score lines 16*c*', comprising an extension of the score line 16*c* and also defining ends of the side panels 18 and 19. A second pair of corner flaps 26 likewise is defined flanking the end panel 25 at the opposite side of the box blank 15.

Separate flaps 29 and 30 are formed at the terminal ends of the end panels 24 and 25. The flaps 29 and 30 preferably extend the width of the respective end panels 24 and 25 to provide the most effective closure of the box, as will become apparent. The score lines 16*e* along the end panels 24 and 25, parallel to the respective score lines 16*c* defining the end panels, define the respective flaps 29 and 30. Elongated slits 31 and 32 are formed in the respective flaps 29 and 30, paralleling the longitudinal dimension of those flaps. The slits 31 and 32 preferably are formed as cuts through the material of the box blank 15 without removing any significant amount of that material, and so the slits have minimal width.

The box blank 15 also includes a pair of secondary end panels 75 each foldably connected to opposite ends of the top panel 20 by the score lines 16*f*, comprising an extension of the score lines 16*c* in the bottom panel 17 and 16*c*' in the side panels 18 and 19. The secondary end panels 75 are substantially rectangular and have approximately the same size as the end panels 24 in the preferred embodiment. One end 77 of each secondary end panel 75 lies adjacent to a corner flap 26, and an elongated cut 76 along the confronting side of each corner flap separates the corner flaps from the adjacent secondary end panels. The width of each cut 76 extends slightly into the end 77 of the secondary end panel 75 to provide clearance for folding the corner flap 26 at a right angle to the secondary end panel, as becomes evident below.

Figure 2:
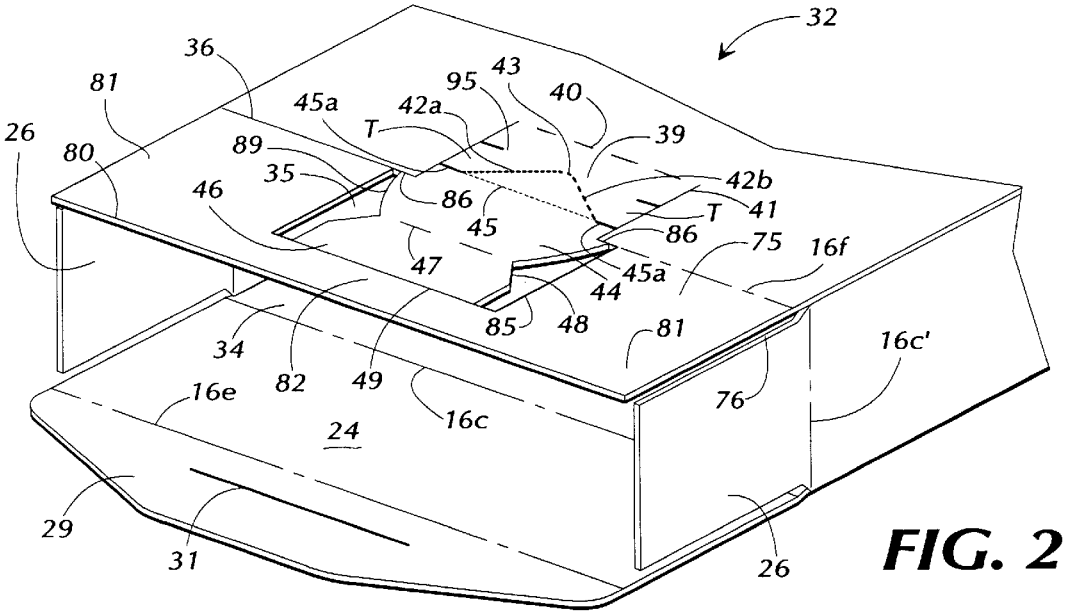
FIGS. 2–4 are fragmentary pictorial views showing a box assembled from the blank of FIG. 1 and illustrating progressive stages of closing and locking an end panel of the box.

Turning now to FIG. 2, the box 32 shown in that figure is assembled from the box blank 15 shown in FIG. 1 by folding the box blank along the score lines 16*a*, 16*b*, 16*g*, and 16*h* so that the bottom panel 17, side panels 18 and 19, and top panel 20 bear an orthogonal three-dimensional relation to each other as shown in that figure. The top panel 20 overlays and is adhesively attached to the glue flap 21 to maintain the assembled configuration of the box 32. The details of fabricating box blanks from corrugated board or other materials, and producing boxes from such blanks, are well known to those skilled in the art and need not be repeated herein.

A central portion of each secondary end panel 75 is cut away to define an open space 35. One part of a locking tab 38 is located in the open space 35, with the remaining part of the locking tab extending into the adjacent end of the top panel 20. The score line 16*f*, forming an extension of the score line 16*c* and 16*c*', joins the secondary end panel 75 to the top panel 20 and defines a fold line along which the secondary end panel can fold relative to the top panel. The score line 16*f* thus also defines the forward edge 36 of the top panel 20.

The locking tab 38 has three distinct segments, starting with a shank 39 located in the top panel 20 and defined by a perforation line 40 in the top panel parallel to the score line 16*f* and set inwardly from that score line. The two parallel cut lines 41, perpendicular to the perforation line 40 and extending outwardly from that line to intersect the fold line 16*f* defining end 36 of the top panel 20, further define the shank 39. The perforation line 40 preferably is formed by perforations extending across the width of the locking tab 38. The perforation line 40 defines a hinge that allows the shank 39 of the locking tab 38 to bend relative to the plane of the top panel 20.

Joining the shank 39 of the locking tab 38 is the central panel 44 defined by the fold line 45 scored parallel to the perforation line 40 and inset from the score line 16*f* (and from the forward edge 36 of the top panel 20) by a lesser distance than is the perforation line 40. The fold line 45 preferably is cut at 45*a* along each end of its length. The use of a partially cut fold line 45, instead of an ordinary perforated fold line, to join the central panel 44 to the shank 39 is preferred because the central panel and the shank will undergo bending at an acute angle during the locking procedure explained below.

The shank 39 also has at least one perforation 95 intersecting the respective cut lines 41 and located on an imaginary line between and parallel to the perforation line 40 and the fold line 45. The perforations 95, although aligned parallel to the perforation line 40 and fold line 45, are not intended to define a perforated fold line for folding the shank. However, the perforations 95 do impart a region of structural weakness to the shank 40 between the perforation line 40 and fold line 45.

Two additional perforated lines 42*a* and 42*b*, together having the appearance of an inverted V, are formed on the shank 39 of the locking tab. Those additional perforated lines assist in unlocking the box in a predetermined manner after the box is locked, as described below. One end of the perforated line 42*a* joins the fold line 45 at the inner end of one cut 45*a* partially forming the fold line. The perforated line 42*a* extends on a generally diagonal path from one cut to a terminal point 43 midway across the width of the shank 39 and on the imaginary line connecting the perforations 95. The other perforated line 42*b* likewise has one end joining the cut 45*a* at the other end of the fold line. The perforated line 42*b* extends on a generally diagonal path mirroring the path of the perforated line 42*a* and ends at the terminal point 43. The perforations 95, the terminal cuts 45*a* of the fold line 45, and the diagonally-extending perforation lines 42*a* and 42*b*, thus cooperate to define the opening tabs T extending a short distance across the width of the locking-tab shank 39 from both sides of that shank.

The central panel 44 extends outwardly from the fold line 45 and beyond the forward edge 36 of the top panel 20 to join the front panel 46 across the partially-perforated score line 47, parallel to the fold line 45 and the perforation line 40. The front panel 46 thus is foldable relative to the central panel 44. A V-shaped notch 48 is cut into each side of the central panel 44 and the front panel 46, the apex of each notch aligned with corresponding ends of the score line 47 separating the front panel from the central panel. The central panel 44 and front panel 46 together form a locking panel 50 (FIG. 1) of the locking tab 38, and the notches 48 help guide the locking panel into the slit 31 of the flap 29 in a manner to be described. As best seen in FIG. 1, the sides 51 of the front panel 46 are flared outwardly toward the terminal end 49 of the front panel, instead of being perpendicular to the terminal end. This outward flare of the sides 51, together with the notches 48 formed between the central and front panels, help assist the locking panel 50 in entering the slit 31 of the flap 29, as described below.

Each locking tab 38 is formed in the box blank 15 by the perforation line 40 and the cut lines 41 in the top panel 20 as mentioned above, and by additional cuts in the secondary end panels 75. The terminal end 49 of the front panel 46 is formed by a cut line parallel to the terminal edge 80 of the secondary end panel 75, and spaced inwardly a distance from that terminal edge.

A strip 82 of the secondary end panel 75, between the terminal end 49 of the locking tab 38 and the terminal end 80 of the secondary end panel itself, thus bridges the open space 35 between the two end portions 81 of the secondary end panel. That bridging strip 82 ensures that the secondary end panel 75 remains a unitary element foldable on the score line 16*f*. The regions between the notches 48 on each side of the locking tab 38, and the confronting sides 85 of the open space 35 in the secondary end panel 75, are cut out as the box blank 15 is produced and remain as open spaces in the secondary end panel.

The width of the shank 39 between the two cut lines 41 is somewhat less than the corresponding width of the central panel 44 commencing at the fold line 16*f* and the forward edge 36 of the top panel 20. Those different widths produce the separate flanges 86 on each side of the central panel 44 comprising the locking tab 38. These flanges 86 are contiguous with the forward edge 36 of the top panel 20 and with the fold line 16*f* defining that forward edge. The purpose of the flanges 86 is discussed below.

After the box 32 is assembled as shown in FIG. 2, that box may be closed and locked as described with reference to FIG. 3. The corner flaps 26 first are turned inwardly 90° around the fold lines 16*c*' to extend across the open end 34 of the box. The secondary end panel 75 then is folded downwardly along the fold line 16*f* to cover the corner flaps and the remainder of the open end 34. The locking tab 38 becomes separated from the plane of the secondary end panel 75 as that latter element is folded downwardly, as shown in greater detail in the aforementioned U.S. Pat. No. 5,507,428 . The locking tab 38 may now be turned upwardly around the perforated line 40 to expose an open space in the top panel 20, which is contiguous to the open space 35 in the secondary end panel 75. Next, the end panel 24 is folded upwardly around the score line 16*c* to cover the end 34 of the box 32. The end panel 24 in this position is parallel to the secondary end panel 75 and located immediately in front of that secondary end panel. In this position, the flap 29 of the end panel extends over the forward edge 36 of the top panel 20 and overlaps a forward portion of that top panel, as seen in FIG. 3.

Figure 3:
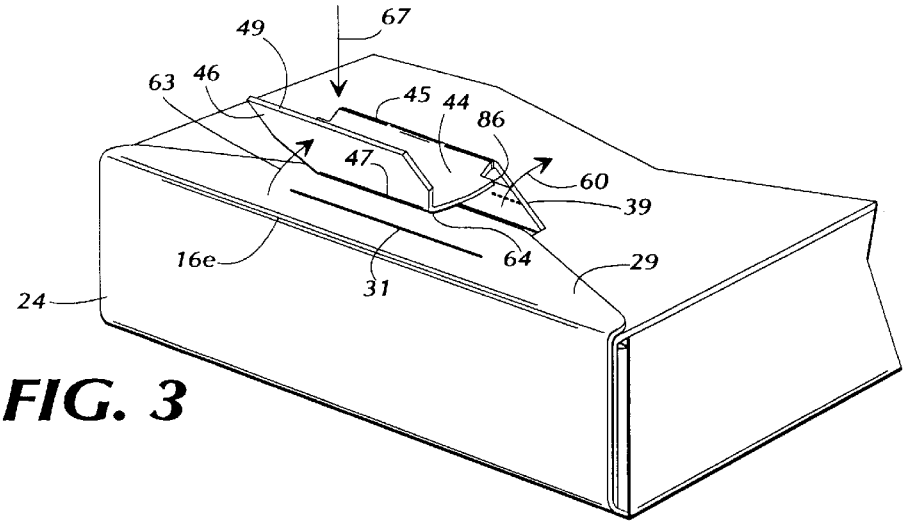

When the end panel 24 is fully closed as shown in FIG. 3, the flap 29 substantially covers the previously-exposed open space 35 in the top panel 20. The locking tab 38 may now be folded back on itself as shown in FIG. 3, by folding the shank 39 rearwardly at the perforated line 40. The arrow 60 in FIG. 3 represents that movement. At the same time, the central panel 44 may be folded downwardly along the perforated line 45 to assume a nearly vertical position with respect to the top panel 20 and the flap 29. The front panel 46 in this position is folded back along the score line 47 adjoining the central panel 44, so that the front panel and central panel move toward each other as shown in FIG. 3. This desired folding movement of the front panel 46 is shown by the arrow 63, in FIG. 3. The front panel 46 and central panel 44 of the locking tab 38 thus are folded accordion-fashion into closely-abutting contact with each other, although for illustrative purposes those panels are shown in FIG. 3 with greater separation.

Figure 4:
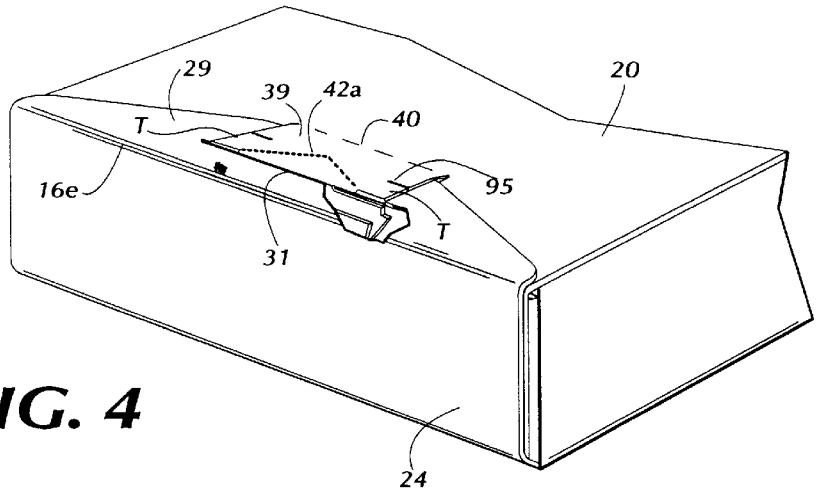

With the locking tab 38 thus folded so that the shank 39 is angled upwardly from the top panel 20, and the central panel 44 and front panel 46 are folded accordion-fashion to contact each other, the perforated line 47 becomes aligned substantially above the slit 31 in the flap 29 of the end panel 24. The notches 48 on both sides of the locking panel 50 now overlie each other to define the beveled corners 64 at each end of the folded score line 47. By exerting downward force on the top of the now-folded locking panel as shown by arrow 67, the folded locking panel enters the slit 31 as the shank 39 of the locking tab 38 returns toward a position closely overlaying the end flap 29 and substantially parallel therewith, as shown in FIG. 4. The flared sides 51 of the front panel 46 also assist in guiding the locking panel 50 downwardly through the slit 31.

The distance between the perforated line 45 and the perforated line 47 across the locking tab 38 is marginally greater than the corresponding distance between that perforated line and the terminal end 49 of the front panel 46 on the locking tab. This difference makes the length of the front panel 46 (measured in a direction parallel to the cut lines 41) marginally less than the corresponding length of the central panel 44. Because the front panel 46 of the locking tab is shorter than the central panel 44, the terminal end 49 of that front panel becomes located a short distance below the perforated line 45 when the front panel is folded in the direction 46 illustrated in FIG. 3 to lie alongside the central panel 44. As a result, the terminal end 49 of the front panel 46 becomes pushed completely through the slit 31 when the locking panel is pushed to the fully-engaged position shown in FIG. 4, where the shank 39 is substantially parallel with the top panel 20 of the box. When the terminal end 49 of the front panel 46 on the locking tab thus clears the underside of the slit 31, the resiliency of the hinge provided by the perforated line 47 pivots that front panel forwardly toward the end panel 24 of the box. The terminal end 49 thus moves out of registry with the slit 31 and becomes lodged in the corner on the inner side of the fold line 16*e* where the flap 29 joins the end panel 24 of the box. This lodgment of the terminal end 49 thus captures the locking tab 38 on the inside of the box 32, securing the end panel 24 of the box over the end of the box as seen in FIG. 4. It is now impossible to withdraw the front panel 46 of the locking tab 38 from the slit 31, or otherwise to disengage the locking tab from the remainder of the box, without cutting or tearing some visible portion of the locking tab or otherwise mutilating the box so that the tampering becomes evident to an observer.

With the box 32 closed, the combined presence of the corner flaps 26, the secondary end panel 75, and the end panel 24 juxtaposed with each other across the end of the box effectively prevents anyone from prying or bending back the end panel in an attempt to see the contents of the box. The shank 39 of the locking tab 38 extends from the perforated line 40 to the slit 31 in the flap 29, and keeps the end panel 24 secured in place across the end of the box. Even if a person manages to bend the end panel 24 somewhat back from the end of the box by deforming the end panel, the secondary end panel 75 remains in place to block visual and physical access to the interior of the box.

Because the slit 31 in the flap 29 is longer than the width of the central panel 44 and of the front panel 46 making up the locking panel 50, that locking panel passes through the slit without interference with the flanges 86 at each end of the central panel. The accordion-folded central panel 44 and front panel 46 make a tight fit while being pushed downwardly through the slit 31, but that slit preferably is long enough to permit the flap portions on either side of the slit to temporarily deform or deflect as the locking panel moves through the slit.

Although the flanges 86 on the central panel 44 can pass through the slit 31 without interfering with the ends of that slit, the lateral extent of those flanges is greater than the corresponding width of the open space remaining in the top panel 20 when the shank 39 is turned upwardly from the plane of the top panel. FIG. 1 best shows this relationship between the width of the shank 39 between the parallel cut lines 41, and the greater lateral extent of the flanges 86 that extend outwardly adjacent to the shank 39. Because the flanges 86 laterally extend beyond the sides (defined by the cut lines 41) of the open space formed when the shank 39 is turned upwardly around the fold line 40, those flanges resiliently and deformably pass between those sides as the locking panel 50 is pressed downwardly through the slit 31 to lock the box closed. The leading edge 89, FIG. 2, of each flange 86 preferably is curved or angled outwardly from the score line 47 to the flange, to assist the flanges in moving past the interfering sides of the open space. Once those flanges have moved past the sides, each flange resiliently expands substantially to its original size and engages the underside of the top panel 20, effectively securing the locking tab 38 in place within the box 32 and preventing any nondestructive withdrawal of that locking tab.

The flanges 86 on the central panel 44 provide an additional measure of security for the locked box. If a person attempts to jimmy open the folded locking panel 50 by inserting a blade or other thin tool through the slit 31 of the locked box, either of two results is likely to occur. The first likelihood is that the person probing with the thin tool will tear apart the perforated line 47, thereby separating the central panel 44 from the front panel 46 of the locking tab 38. If that separation takes place, the terminal end 49 of the front panel 46 no longer remains engaging the inside corner formed by the fold line 16*e*.

However, the flanges 86 on the central panel 44 continue to engage the underside of the top panel 20 at the sides 85 of the open space between the cut lines 41, so that the locking tab 38 continues to hold the flap 29 secured over the end of the box as shown in FIG. 4.

The second possible result of probing with a thin tool is that the person may succeed in unfolding the locking panel 50 without rupturing the perforated line 47. This possibility is unlikely, particularly in boxes made according to the present invention and fabricated from relatively stiff material such as corrugated board. Nonetheless, if unauthorized probing does succeed in moving downwardly the front panel 46 of the locking tab 38 within the locked box, without rupturing the perforated line 47, the flanges 86 of the central panel 44 again remain in place engaging the underside of the top panel 20 at the sides of the open space. This engagement prevents withdrawing the locking tab from the box, so that the box remains closed and locked.

The perforated line 40 securing the locking tab 38 to the top panel 20 of the box provides still another measure of security. That perforated line 40 is constructed to provide a predetermined amount of structural weakness to the hinge or fold line joining the locking tab 38 to the top panel. This predetermined amount of weakness does not rupture or tear during normal operation of the locking tab, namely, turning the locking tab upwardly from the plane of the top panel 20 of the box to begin locking the box, and the other normal manipulations of the locking tab as previously described. However, both the perforated line 45 connecting the locking panel 50 (FIG. 1) to shank 39 and the perforated line 47 connecting the central panel 44 to the front panel 46 of the locking tab, are designed to tear apart, and separate the respective elements of the locking tab, in response to applied force exceeding a predetermined amount, especially a tearing force applied to an end of either perforated line.

The selective separability of the perforated lines 40, 45, and 47 makes it virtually impossible to tamper with the locking tab without rupturing some part of that locking tab, thereby leaving irreparable evidence of tampering with the locked box. For example, if a person attempts to open the box by sliding a thin blade into the slit 31 of the flap 29 of the closed box to withdraw or dislodge the locking panel from the slit, that prying movement exerts a tearing force on the perforation lines 45 and 47, and to a lesser extent on perforation line 40. At least one of those perforation lines will rip apart in response to force less than the amount that could force the flanges 86 upwardly past their engagement with the edges on the top panel 20. The tampering person has opened the box, but has done so in a destructive manner providing clear evidence of tampering with the locked box. The selective separability of the perforated line 45, resulting from the predetermined structural weakness of that perforated line, also provides the added advantage of making it easier for an authorized person to open the locked box as discussed below. The perforations 95 on the shank 39 of the locking tab 38 provide further protection from undetected tampering, because those perforations also may tear in response to lifting or tearing forces applied to the locking tab.

The locked box is intentionally opened by separating the locking tab 38 from the remainder of the box, permitting opening the end panel 24 for access to the interior of the box.

Figure 5:
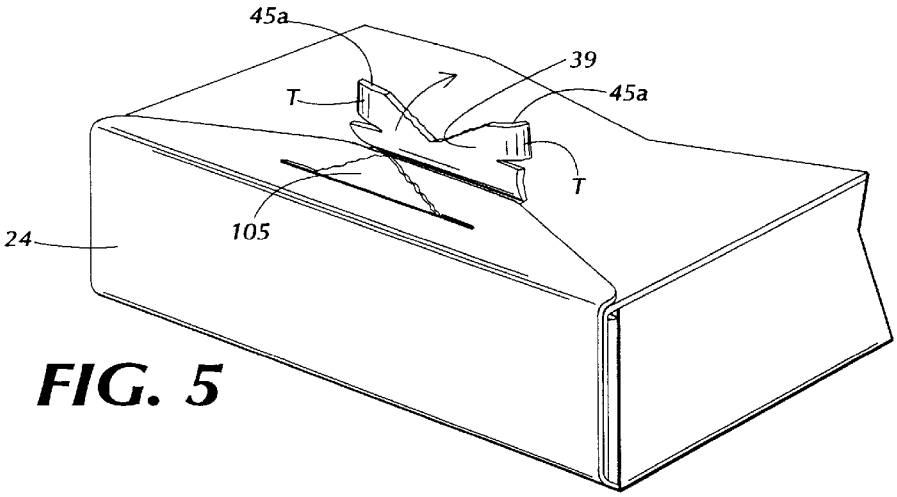
FIG. 5 is a fragmentary pictorial view of the closed box in FIG. 4, showing the locking tab separated by the opening tabs to permit opening the box.

The opening tabs T defined in the shank 39 of the locking tab provide a predetermined and convenient way to separate the locking tab without resorting to a knife, scissors, or other improvised cutting tool. By grasping either opening tab T between a thumb and forefinger of one hand, a person can apply upward force to the opening tab while holding the box stationary with the other hand. That upward force tears the locking tab along the lines of predetermined structural weakness defined by the respective perforation lines 42*a* or 42*b*. The upward force may also cause some tearing beyond the inner end of the perforation line 95 partially defining the opening tab T. Pulling up each opening tab T thus separates the shank 39 across half its width, so that the shank becomes separated from the remainder 105 of the locking tab as illustrated in FIG. 5. That remainder 105 of the locking tab drops or may be pushed into the interior of the box, releasing the end panel for access into the box.

Although the disclosed embodiment uses a single locking tab and complementary slot located midway across each end, boxes according to the present invention alternatively can have more than one locking tab spaced from the sides of the top panel. In that alternative construction, each locking tab selectively engages a separate slot formed in a flap of the end panel. Two separate locking tabs, for example, permit two-point locking of the end panel and may provide greater locking integrity for pizza boxes or the like that have a relatively flat profile or are of noncorrugated or other less-durable material.

That alternate arrangement of locking tabs at each end panel also laterally spaces the paired locking tabs from the midpoints of the end panels, so that each locking tab is less likely to interfere with the contents close to the midpoint of the box.

Although an opening permitting access into the box 32 is shown in each end 34 of that box, with the end panels 32 and 25 constituting closure panels for selectively closing those open ends, boxes according to the present invention can instead be accessible through another panel of the box. For example, either or both relatively-long side panels 18 and 19 could comprise the closure panel selectively closing an opening in corresponding sides of the box. With that alternative construction of the box, a slitted flap like the flap 29 would be part of the selected side closure panel and a locking tab like the tab 38 would be formed in the adjacent part of the top panel 20.

Locking tabs according to the present invention also may be located on any box panel other than the closure panels as defined herein.

It will now be understood that the foregoing relates only to preferred embodiments of the present invention, and that numerous changes and modifications therein may be made without departing from the spirit and scope of the invention as defined in the following claims.

We claim:

1. A box that is lockable when closed and selectively openable when locked, comprising:

a plurality of body panels interconnected to form the box;

a closure panel connected to one of said body panels to selectively close an opening of the box and having a flap extending into the box to occupy a location adjacent to another of said body panels when the closure panel closes the opening;

a slot associated with a first one of said body panels of the box;

a locking tab associated with a second one of said body panels of the box and extending a predetermined dimension for selective interlocking engagement with the slot when the box is closed, thereby preventing opening the box without damaging the box; and means on the locking tab to define an opening tab at one side of the locking tab and extending at least partially across the width of the locking tab, the opening tab operating to separate at least a portion of the opening tab in a predetermined manner in response to pulling the opening tab in a direction substantially outwardly from the locking tab, whereby separating the locking tab in the predetermined manner permits opening the box without withdrawing the locking tab from the interlocking engagement with the slot.

2. The box as in claim 1, wherein:

the closure panel comprises an end panel of the box; and the opening comprises an end of the box adjacent to the end panel, so that the end panel selectively closes the end of the box whereupon the locking tab selectively interlocks the slot to prevent opening the box without damage.

3. A box as in claim 2, wherein:

the locking tab has a first fold line defining a locking panel for insertion in the slot;

the locking panel has a central portion and a second fold line defining a terminal portion selectively foldable to lie alongside the central portion with the fold line thereby forming a leading edge of the folded locking panel;

the locking panel with the terminal portion so folded is aligned for insertion by the leading edge through the slot into the box when closed, whereat the terminal portion partially unfolds to abut the end panel, thereby locking the first panel to the second panel to hold the box closed; and the means defining the opening tab is spaced apart from the first fold line and extends at least partially across the locking tab so as to separate the locking panel from the remainder of the locking tab, when pulled outwardly and across the locking tab.

4. The box in claim 3, wherein the opening tab is formed by a region of predetermined weakness defined in the locking tab and operative to separate from the locking tab in a predetermined manner in response to pulling the opening tab outwardly and across the locking tab.

5. The box as in claim 3, further comprising:

a first region of predetermined weakness extending from a first point on the first fold line to a terminus longitudinally spaced from the first fold line, and a second region of predetermined weakness extending from a second point on the first fold line to the terminus; and the opening tab being defined in part by one of the first and second regions and by a weakened region extending from an edge of the locking tab part-way along a line substantially coextensive with the terminus of the first and second regions, so that pulling the opening tab separates the one region from the locking tab in the predetermined manner.

6. The box as in claim 5 wherein:

said opening tab comprises one of two such opening tabs;

each such opening tab being defined in part by the respective first and second regions, and by the weakened region, so that pulling the opening tabs separates the first and second regions from the locking tab, thereby separating the locking tab from the remainder of the box.

7. The box as in claim 1, wherein the means comprises a cut at an end of a fold line extending across the width of the locking tab, whereby the cut at least partially defines the opening tab for grasping and pulling to separate the locking tab in said predetermined manner.

8. A box that is lockable when closed and selectively openable when locked, comprising:

a plurality of body panels interconnected to form the box;

a closure panel connected to one of said body panels to selectively close an opening of the box and having a flap extending into the box to occupy a location adjacent to another of said body panels when the closure panel closes the opening;

a slot associated with a first one of said first body panels of the box;

a locking tab associated with a second one of said body panels of the box and extending a predetermined dimension for selective interlocking engagement with the slot when the box is closed, thereby preventing opening the box without damaging the box; and an opening tab defined in the locking tab and extending at least partially across the predetermined dimensions of the locking tab so as to separate at least a portion of the locking tab in a predetermined manner in response to pulling the opening tab in a direction across the locking tab, whereby separating the locking tab in the predetermined manner permits opening the box;

the closure panel comprising an end panel of the box;

the opening comprising an end of the box adjacent to the end panel so that the end panel selectively closes the end of the box whereupon the locking tab selectively interlocks the slot to prevent opening the box without damage;

a fold line extending across the locking tab;

a first region of predetermined weakness extending from a first point on the fold line to a terminus longitudinally spaced from the fold line, and a second region of predetermined weakness extending from a second point on the fold line to the terminus; and the opening tab being defined in part by one of the first and second regions and by a weakened region extending from an edge of the locking tab part-way along a line substantially coextensive with the terminus of the first and second regions, so that pulling the opening tab separates the one region from the locking tab, thereby separating the locking tab in the predetermined manner to permit opening the box.

9. A box as in claim 8, wherein:

said opening tab comprises one of two such opening tabs; and each such opening tab being defined in part by the respective first and second regions, and by the weakened region, so that pulling the opening tabs separate the first and second regions from the locking tab.

* * * * *